US007528805B2

(12) United States Patent
Kao et al.

(10) Patent No.: US 7,528,805 B2
(45) Date of Patent: May 5, 2009

(54) METHOD TO REDUCE IMAGE STICKING IN PLASMA DISPLAY PANELS

(75) Inventors: Hsu-Pin Kao, Chang Hua Hsien (TW); Yi-Chia Shan, Jhongli (TW); Tsan-Hung Tsai, Sanchong (TW); Hsu-Chia Kao, Pingjhen (TW)

(73) Assignee: Marketech International Corp., Taipei (TW)

( * ) Notice: Subject to any disclaimer, the term of this patent is extended or adjusted under 35 U.S.C. 154(b) by 627 days.

(21) Appl. No.: 11/387,641

(22) Filed: Mar. 24, 2006

(65) Prior Publication Data

US 2007/0222711 A1 Sep. 27, 2007

(51) Int. Cl.
*G09G 3/28* (2006.01)

(52) U.S. Cl. ..... 345/63; 345/60

(58) Field of Classification Search ..... 345/60, 345/61, 62, 63

See application file for complete search history.

(56) References Cited

U.S. PATENT DOCUMENTS 6,313,878 B1 * 11/2001 Jankowiak ..... 348/377
2006/0001601 A1 * 1/2006 Ono ..... 345/60
2007/0075928 A1 * 4/2007 Takeuchi et al. ..... 345/63

* cited by examiner

*Primary Examiner*—Amare Mengistu
*Assistant Examiner*—Koosha Sharifi
(74) *Attorney, Agent, or Firm*—Egbert Law Offices PLLC

(57) ABSTRACT

The method to reduce image sticking in a plasma display panel (PDP) includes four steps. There is converting a relationship between gray level and brightness of an input signal into a linear relation by a converter. Next, there is recording an image with a static image detector at time t using a frame buffer, and after a period of time Δt, comparing the image at time t with the image at time t+Δt, thereby identifying static or dynamic images in the pixel. Then, there is recording a gain of every pixel by a brightness regulator using an image gains memory buffer zone, the gain being regulated according to detection results of the static image detector. Finally, there is improving gray level performance of output images by a gray level promoter and brightness converter. Thus, method actively detects static pixels and reduces brightness in the static region for minimized image sticking.

7 Claims, 2 Drawing Sheets

METHOD TO REDUCE IMAGE STICKING IN PLASMA DISPLAY PANELS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a method to reduce image sticking in plasma display panels. More particularly, the invention allows active detection of static pixels in images and reduction of brightness for minimized image sticking.

BACKGROUND OF THE INVENTION

The Plasma Display Panel (PDP) is a currently mainstream, large-sized, and thin-profile display panel featuring a bigger frame, higher quality, a wider visual angle and lower radiation. However, the Plasma Display Panel (PDP) still faces the problem of image sticking, wherein image retention takes place after a static image is displayed on a PDP for a certain period of time. As illustrated in FIG. 1, when a Plasma Display Panel 10 highlights the font of "PDP" 20A, and then becomes a dark display (FIG. 2) and then a white display (FIG. 3), the image retention of PDP will take shape, forming aforementioned image sticking 20B, 20C.

Therefore, this industry has developed several solutions to address image sticking of Plasma Display Panel (PDP) as detailed herein.

Image Shifting

The static image shifts leftward, rightward, upward and downward by a few pixels every several seconds or minutes, thereby avoiding fixation at a certain location. However, this method has poor performance, owing to the fact that only a few pixels shift by this method. Otherwise, the user can easily notice the dithering of images or shifting beyond the boundary. As shown in FIG. 1, since the font size of "PDP" represents a wide area of pixels, a limited pixel shift cannot bring the original font of "PDP" into a completely dark region. Thus, image sticking cannot be affected by the image shifting method as shown in FIG. 1.

Gray Level Image Reversal

Gray level reversal is applied to enable an entire screen of a Plasma Display Panel (PDP) to be highlighted equally for showing a uniform feature and lower image sticking. As shown in FIG. 1, after the font of "PDP" is highlighted for a period of time, the image of the same font with a white background and black character is also highlighted. Thus, difference in highlighting the pixels is averaged by the panel to reduce image sticking. This method, however, has the following limitations:

a. Unable to identify accurately gray level reversal time. Prolonged image reversal will likely lead to image sticking at the other direction; and b. Unable to generate gray level reversal images of a static display. For example, if "Bshi TV" is broadcast live, the font of "Bshi" will appear at an upper right corner for a long time, where image sticking of "Bshi" will take place. In such case, it is unlikely to generate gray level reversal images of "Bshi" font to reduce image sticking.

White Bar Image Removal

When white bars run vertically or horizontally, it is possible to remove image sticking in a similar way as a screen wiper. However, striped images will occur on the display, leading to discomfort of the users.

All-White Display Heating

This method enables all images to be displayed uniformly. However, this method generally requires a long-lasting heating process, and also leads to unsatisfactory result in this regard.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The enhanced efficacy of the present invention is presented herein.

A method to reduce image sticking of a plasma display panel can actively detect static pixel in the images in the PDP and can reduce the brightness (discharge frequency) in the static region for a minimized amount of image sticking. For a large-area or local static image, the same level of image sticking can be realized without any influence upon normal display of images, nor removing image sticking by means of all-white display heating. This will facilitate efforts to improve considerably the performance and quality of the PDP.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
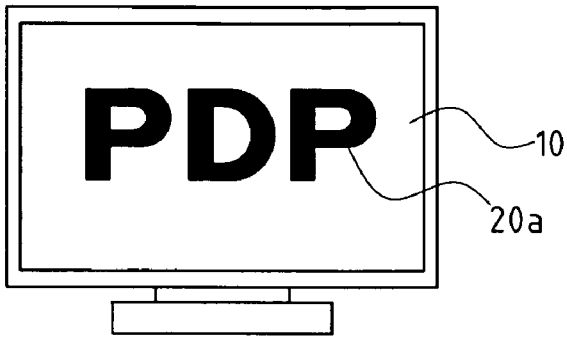
FIG.1 PRIOR ART
FIG. 1 shows an elevation view of a normal plasma display panel (PDP).
Figure 2:
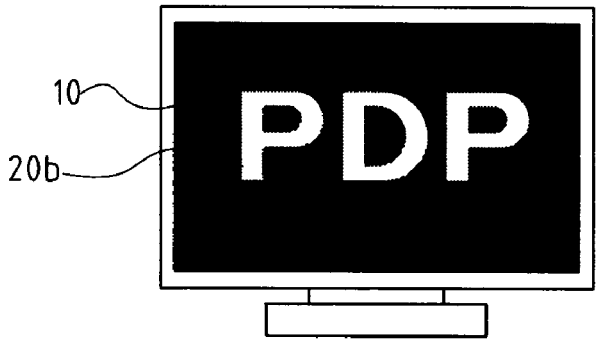
FIG.2 PRIOR ART
FIG. 2 shows another elevation view of the image sticking on dark display based on the "PDP" in FIG. 1.
Figure 3:
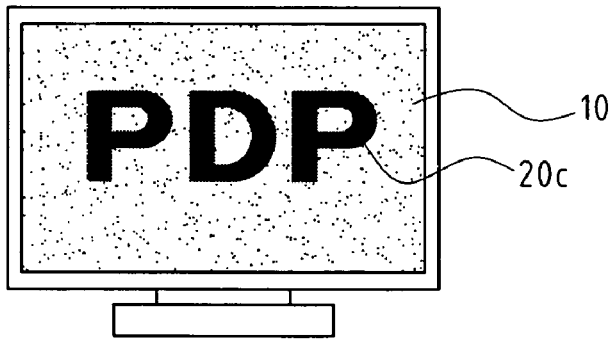
FIG.3 PRIOR ART
FIG. 3 shows still another elevation view of the image sticking on a white display based on the "PDP" in FIG. 1.
Figure 4:
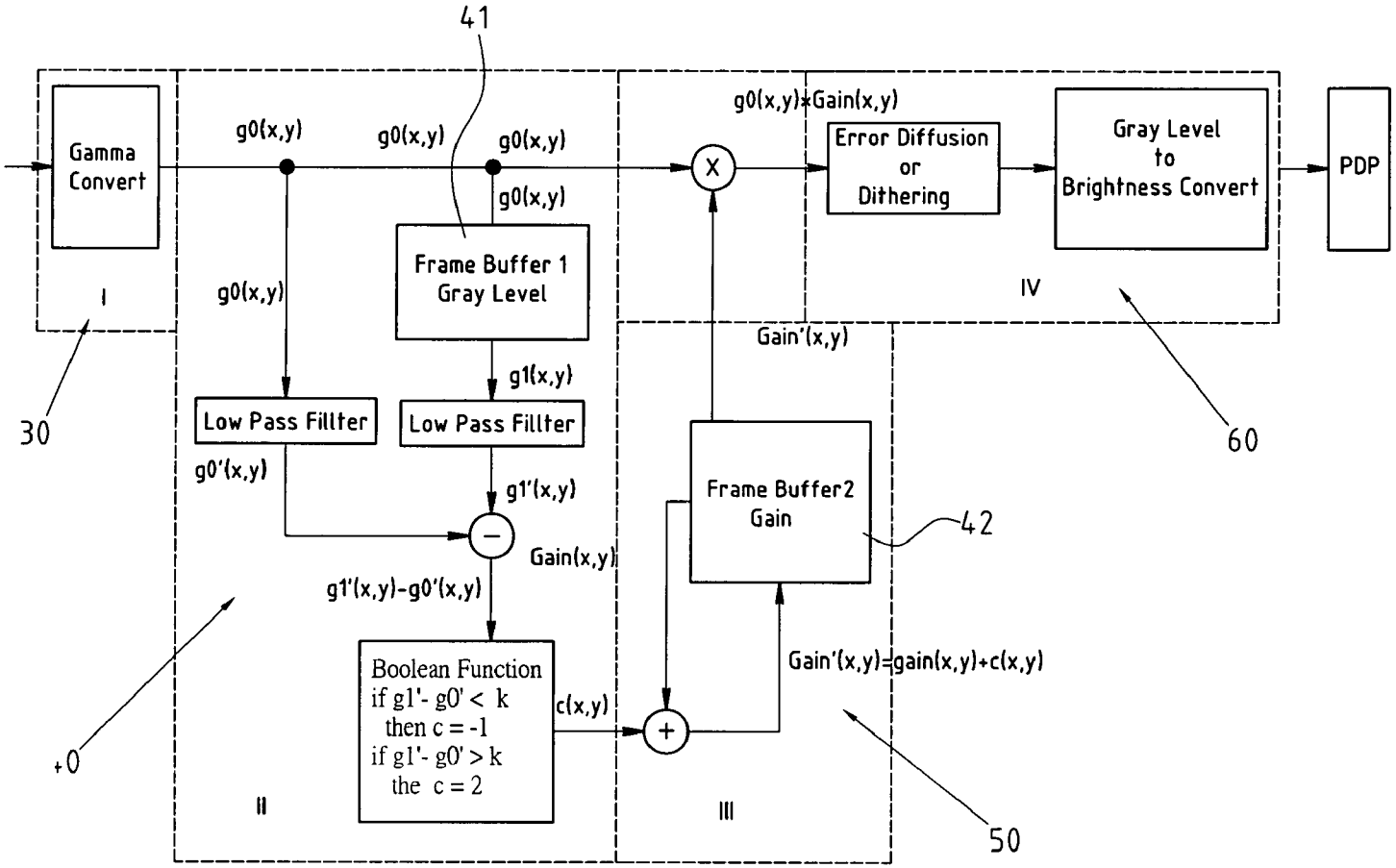
FIG. 4 shows a schematic view of a flowchart of the preferred embodiment of the present invention.

FIG. 4 depicts an improved embodiment of a Plasma Display Panel (PDP) for decreased image sticking, which places no restriction on the claims. A method to reduce image sticking of plasma display panel, comprises four parts: a Gamma converter 30, static image detector 40, brightness regulator 50, and gray level promoter and brightness converter 60.

The Gamma converter 30 is aimed to convert the relationship between gray level and brightness of an input signal into a linear relation. For example, Gamma 0.45 shows the relationship between the gray level and brightness of a traditional video signal. Gamma converter 30 permits a Gamma 2.2 conversion of the input signal, thus achieving linear relationship between gray level and brightness. This makes it possible to accurately predict the expected brightness based on a gray level via a simple circuit.

The Static image detector 40 includes a frame buffer 41 is used to record the image at time t, and after a period of time Δt, the frame buffer 41 compares the image at time t with the images at time t+Δt, thereby identifying static or dynamic images in the pixel. Prior to identification of static images, a low pass filter is required to filter the images at time t and time t+Δt, thus reducing the influence of noise. If a static image is identified, then the compensation parameter for the brightness regulation gain is a negative value (c=−1 in FIG. 4). If a dynamic image is identified, then the compensation parameter for brightness regulation gains is a positive value (c=+2 in FIG. 4).

The Brightness regulator 50 has an image gains memory buffer zone 42 used to record Gain(x,y) of every pixel, which is regulated according to the detection results of the static image detector 40. When a static image is detected by static image detector 40, the corresponding gains in the buffer zone are added with a corresponding brightness gain compensation coefficient c (c is a negative value), thereby minimizing the gains. On the other hand, when a dynamic image is detected by the static image detector 40, the corresponding gains in the buffer zone is added to the corresponding brightness gain compensation coefficient c (c is a positive value), thereby increasing the gains. Then, every pixel of the input image is multiplied by corresponding gains for output, thereby reducing the brightness of static image.

In practice, gains recorded in the image gains memory buffer zone 42 will be multiplied by 256 times ($2^n$ times), and then divided by 256 for output after the input image is multiplied by this expanded gains. It should be possible to increase the resolution of gains and to simplify the hardware resource required for multiplication (division). Let gains=256 at the very beginning (t=0). If static images are displayed, the gain in the frame buffer is 256−1=255 after a period of time Δt, and declines to 256−n after a period of time t=n*Δt. After being multiplied by this gain and then divided by 256, it is possible to decrease the image brightness. Otherwise, when dynamic images are displayed, the corresponding gain shall be increased to restore the image brightness in this region. To avoid extremely low brightness in static regions or extremely high brightness in dynamic region after brightness regulation, the gains in image gains memory buffer zone 42 are limited to some extent. If the minimum gain is limited to 64, the maximum range of brightness reduction in static region is limited to ¼ of original brightness. If maximum gain is limited to 256, the gains in dynamic region plus brightness gain compensation coefficient is limited to be less than 256, thus avoiding an unexpected brightness.

Gray level promoter and brightness converter 60 works with the brightness regulator 50, allowing for multiplication of images. Since some gray level details cannot be directly displayed in a digital circuit after multiplication, Spacial Error Diffusion or Time Dithering shall be applied to increase the gray level of output images for an improved performance of display.

The gray level and brightness (discharge frequency) of PDP modules may not present a linear relationship before the aforementioned image gray level is output to the display. To decrease and suppress the image sticking accurately, the conversion between image gray level and brightness (discharge frequency) of PDP shall be required to maintain linearity between the image gray level and brightness before the image gray level is output to the display.

We claim:

1. A method to reduce image sticking in plasma display panels, said method comprising the steps of:

converting a relationship between gray level and brightness of an input signal into a linear relation by a converter, making expected brightness based on gray level accurately predictable via a simple circuit;

recording an image with a static image detector at time t using a frame buffer, and after a period of time Δt, comparing the image at time t with the image at time t+Δt, thereby identifying static or dynamic images in the pixel, wherein a compensation parameter for brightness regulation gains is a negative value if a static image is identified, and wherein the compensation parameter for brightness regulation gains is a positive value if a dynamic image is identified; and recording a gain of every pixel by a brightness regulator using an image gains memory buffer zone, said gain being regulated according to detection results of said static image detector, wherein a corresponding gain in the buffer zone is added to a corresponding brightness gain compensation coefficient c, when a static image is detected by said static image detector so as to minimize the gains, wherein the corresponding gain in the buffer zone is added to the corresponding brightness gain compensation coefficient c, when a dynamic image is detected by said static image detector so as to increase the gains, and wherein every pixel of an input image is multiplied by corresponding gains for output, thereby reducing brightness of the static image.

2. The method defined in claim 1, further comprising:

allowing low-pass filtering of images by said static image detector at time t and time t+Δt, reducing influence of noise prior to identification of static images.

3. The method defined in claim 1, further comprising:

expanding the gains recorded in gains memory buffer zone by 256 times ($2^n$ times) by said image brightness regulator, the gains being multiplied by input image and then divided by 256 for output.

4. A method to reduce image sticking in plasma display panels, said method comprising the steps of:

converting a relationship between gray level and brightness of an input signal into a linear relation by a converter, making expected brightness based on gray level accurately predictable via a simple circuit;

recording an image with a static image detector at time t using a frame buffer, and after a period of time Δt, comparing the image at time t with the image at time t+Δt, thereby identifying static or dynamic images in the pixel, wherein a compensation parameter for brightness regulation gains is a negative value if a static image is identified, and wherein the compensation parameter for brightness regulation gains is a positive value if a dynamic image is identified;

recording a gain of every pixel by a brightness regulator using an image gains memory buffer zone, said gain being regulated according to detection results of said static image detector, wherein a corresponding gain in the buffer zone is added to a corresponding brightness gain compensation coefficient c, a negative value, when a static image is detected by said static image detector so as to minimize the gains, wherein the corresponding gain in the buffer zone is added to the corresponding brightness gain compensation coefficient c, a positive value, when a dynamic image is detected by said static image detector so as to increase the gains, and wherein every pixel of an input image is multiplied by corresponding gains for output, thereby reducing brightness of the static image; and improving gray level performance of output images by a gray level promoter and brightness converter.

5. The method defined in claim 4, further comprising:

allowing low-pass filtering of images by said static image detector at time t and time t+Δt, reducing influence of noise prior to identification of static images.

6. The method defined in claim 4, further comprising:

expanding the gains recorded in gains memory buffer zone by 256 times (2″ times) by said image brightness regulator, the gains being multiplied by input image and then divided by 256 for output.

7. The method defined in claim 4, wherein said improving gray level performance of output images by said gray level promoter and brightness converter is via spacial error diffusion to time dithering.

* * * * *